US009226536B2

(12) United States Patent
Nordstrom

(10) Patent No.: US 9,226,536 B2
(45) Date of Patent: Jan. 5, 2016

(54) NEGATIVE EDGE COLLAR AND TRIM FOR APPAREL

(71) Applicant: Nike, Inc., Beaverton, OR (US)

(72) Inventor: Matthew D. Nordstrom, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 272 days.

(21) Appl. No.: 13/836,352

(22) Filed: Mar. 15, 2013

(65) Prior Publication Data

US 2014/0259279 A1 Sep. 18, 2014

(51) Int. Cl.

| | |
|---|---|
| ***A41D 27/24*** | (2006.01) |
| ***A41B 3/00*** | (2006.01) |
| *A41B 3/10* | (2006.01) |

(52) U.S. Cl.

CPC ..... *A41D 27/245* (2013.01); *A41B 3/005* (2013.01); *A41B 3/10* (2013.01)

(58) Field of Classification Search

CPC ..... A41B 3/005; A41B 3/10
USPC ..... 2/67, 69, 2.15, 275
See application file for complete search history.

(56) References Cited

U.S. PATENT DOCUMENTS

| | | | | |
|---|---|---|---|---|
| 4,741,050 | A * | 5/1988 | O'Kane et al. | 112/413 |
| 4,889,576 | A | 12/1989 | Suganuma | |
| 5,162,149 | A | 11/1992 | Reaney | |
| 5,950,554 | A * | 9/1999 | Wong | 112/475.09 |
| 6,081,926 | A | 7/2000 | Krause et al. | |
| 6,622,312 | B2 | 9/2003 | Rabinowicz | |
| 7,191,720 | B2 | 3/2007 | Thomas | |
| 7,228,809 | B2 | 6/2007 | Angelino | |
| D627,539 | S | 11/2010 | Flemming | |
| 7,854,022 | B2 | 12/2010 | Warren | |
| 2003/0044563 | A1 | 3/2003 | Kocinec | |
| 2005/0000622 | A1 | 1/2005 | Cano | |
| 2006/0165939 | A1 * | 7/2006 | Hottner | 428/57 |
| 2007/0082165 | A1 | 4/2007 | Barrett | |
| 2008/0196136 | A1 | 8/2008 | Fellouhe | |
| 2010/0125930 | A1 | 5/2010 | Burrell, Iv | |
| 2012/0185994 | A1 | 7/2012 | Liu et al. | |
| 2012/0282425 | A1 * | 11/2012 | Gallagher | 428/61 |
| 2012/0311760 | A1 | 12/2012 | Puni | |

OTHER PUBLICATIONS

International Search Report with Written Opinion dated Jul. 8, 2014 in Application No. PCT/US2014/021900, 15 pages.

(Continued)

*Primary Examiner* — Khaled Annis
(74) *Attorney, Agent, or Firm* — Shook, Hardy & Bacon L.L.P.

(57) ABSTRACT

Connectors are strategically attached using a heat-transfer technique to the fabric of a shirt around the collar and shoulders where seams would typically occur from the front and back pieces of the shirt being sewn together. The connectors continuously follow the perimeter of the collar, intersecting with each other. Front and back neck connectors are positioned along front and back areas of the collar, both intersecting with left and right shoulder connectors that are attached the shirt's left and right shoulders, respectively, where the front and back pieces of the shirt meet. The attached connectors comfortably lie flat against a wearer's skin and provide an enhanced visual effect to the shirt.

19 Claims, 5 Drawing Sheets

(56) References Cited

OTHER PUBLICATIONS

Denver Broncos Men's Jersey. Store [online]. Nike Corporation. Jul. 29, 2012 [retrieved on Jun. 13, 2014]. Retrieved from the internet: <URL http://web.archive.org/web/20120729014213/http://store.nike.com/us/en_us/?1=shop,denver_broncos> entire document.

International Preliminary Report on Patentability dated Sep. 24, 2015 in Application No. PCT/US2014/021900, 9 pages.

* cited by examiner

NEGATIVE EDGE COLLAR AND TRIM FOR APPAREL

BACKGROUND

Athletes look for every edge possible to compete at a higher level. Advances in sports clothing and equipment technology provide numerous advantages on the playing field. Basketball players stay agile on the court with better gripping shoes, lineman wear tighter jerseys so their opponents cannot easily control them, and soccer players opt for jerseys made of lightweight fabrics that keep them drier during games. By providing physical advantageous like being agile, harder to graph, and drier, athletically optimized clothing incidentally helps players remain calm and confident during competition. Sports often require just as much psychological intensity as physical, so anything that keeps an athlete calm under pressure can go a long way in helping the athlete compete.

Collars and seams on athletic apparel present unique opportunities for improvement. When jerseys are worn, collars typically rest in the bottom groove of an athlete's neck, an area prone to collect and pool sweat flowing down the athlete's neck. As a result, collars generally absorb larger amounts of athlete sweat than other portions of a jersey—like the baggier area in front of the stomach. Jerseys and pants are conventionally manufactured by sewing different portions of fabric together at a seam. Resultant seams can be uncomfortable or irritable, especially around the neck and shoulder regions.

Athletic apparel can be a fiercely competitive area of business, so designers strive to develop brand recognition as their technologies advance. Placing a company's logo on shirts and jerseys is commonplace today. The collar and seams of a shirt, however, are somewhat more difficult areas to showcase logos or advertisements because collars may wrinkle and seams do not always lay flat. Today's sporting events may be watched by millions, but much of an athlete's clothing, when worn, is not ideal for placing a logo or advertisement because the clothing's material is not very rigid. Collars, for example, do not always lie flat so anything printed thereon becomes difficult for a fan to see when the player's moving. As brand-recognition becomes more important to every business, advertiser, manufacturer, and team, clothing becomes another place for marketing.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter. Instead, it is provided to explain several different examples of the present invention, but not all examples possible. Thus, this summary should not be relied on to limit claimed subject matter.

One aspect of the invention is directed to a shirt with multiple connectors attached, using for example, a heat-transfer technique, around the neck and shoulder regions. Connectors are positioned atop or beneath portions of the shirt, and either a heat or cold press is used to infuse the connectors to the shirt around the collar and/or shoulder regions. A front neck connector spans the perimeter of the shirt's collar around the front. A back neck connector follows the perimeter of the collar around the back of the shirt. Two shoulder connectors traverse the tops of the shirt's shoulder regions along seams and meet with the front and back neck connectors to form a continuous collar of connectors around the collar. The connectors meet, in one example, by arcuately convex ends of the front and back neck connectors being received—or abutting against—arcuately concave ends of the shoulder connectors. Other examples may form a continuous collar with the connectors using shapes, cuts, or configurations of the connector ends, as well as interlocking pieces—e.g., tongue-and-groove, dovetail, or the like. Collars in various embodiments of the invention provide a smooth contact with a wearer's skin, as well as tantalizing visual appeal.

Connectors may include different materials that, when heated-pressed or cold-pressed, meld with fabric of a shirt to become a permanent affixation. For example, the connectors may be cut, molded, or fashioned out of silicone, thermoplastics polyurethane ("TPU"), thermoplastic, elastomer, rubber, plastic, foam, or some other heat-sensitive material. Additionally, connectors may include electrically conductive or piezoelectric materials capable of generating voltage and current from a wearer's kinetic movement.

Another aspect of the invention deals with affixing shirt portions to connectors and thus alleviating shirt seams that would be formed by sewing or stitching the two portions together. Fabric of a shirt's front portion is attached to a shoulder connector, as is fabric from the shirt's back portion. Using a heat-transfer technique, attaching both portions to the shoulder connectors creates the shirt from the two portions of fabric in a way without seams from stitching or sewing.

BRIEF DESCRIPTION OF THE SEVERAL VIEWS OF THE DRAWINGS

The present invention is described in detail below with reference to the attached drawing figures, wherein.

DETAILED DESCRIPTION

Figure 1:
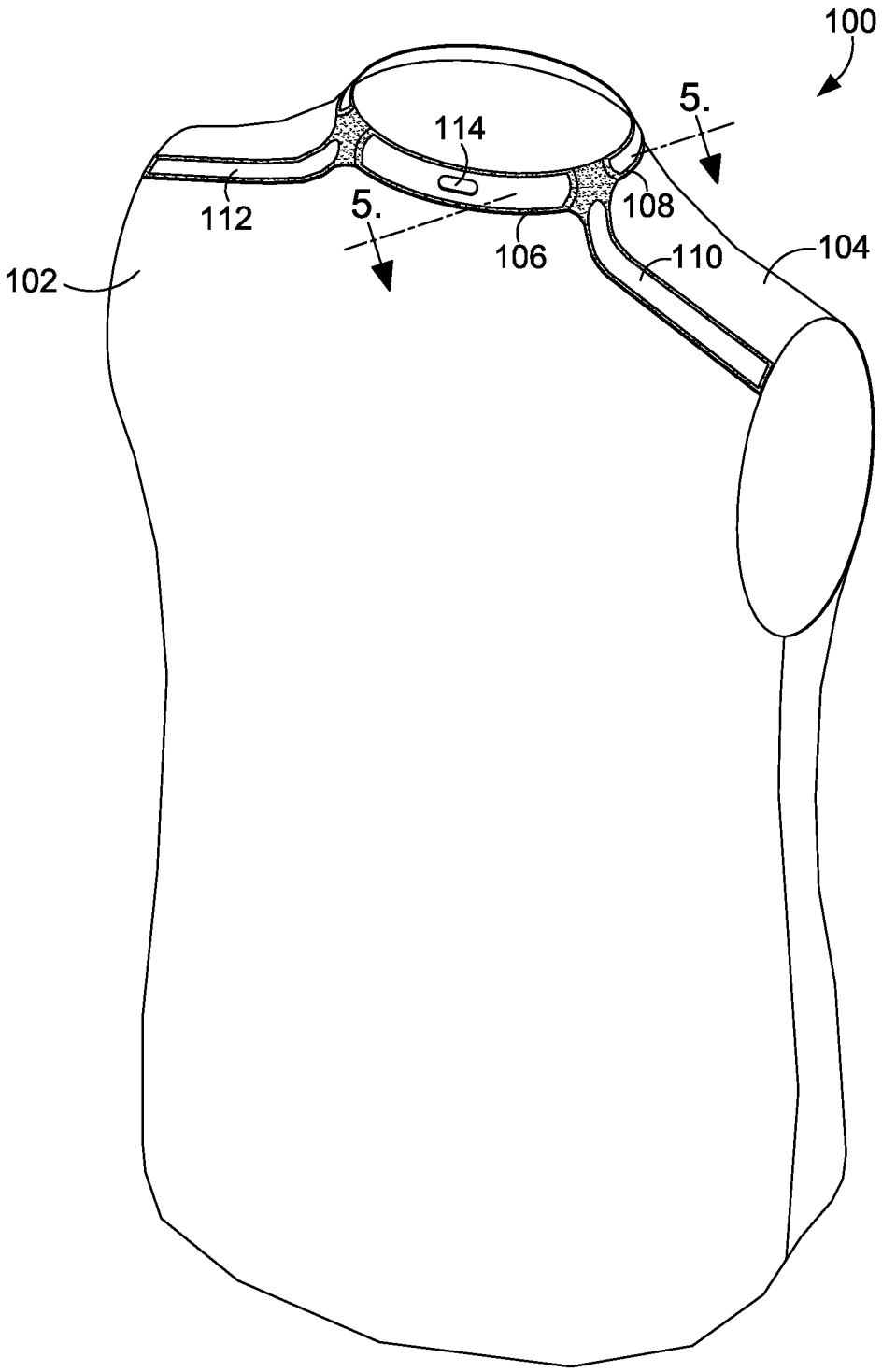
FIG. 1 illustrates a shirt with shoulder and collar connectors in accordance with one example of the present invention.

The subject matter described herein is presented with specificity to meet statutory requirements. The description herein, however, is not intended to limit the scope of this patent. Instead, it is contemplated that the claimed subject matter might also be embodied in other ways, to include different steps or combinations of steps similar to the ones described in this document, in conjunction with other present or future technologies.

In general, the present invention is directed to a shirt with a specialized collar and trims that are attached using a heat-transfer technique. The shirt may be manufactured in several portions that are then assembled together. Front and back portions of the shirt are attached to connectors that follow the perimeter of the shirt's collar and also along the left and right shoulders from the neck to arm regions. The connectors may include different materials, such as silicone, for example but without limitation, TPU, thermoplastic, elastomer, rubber, plastic, foam, or the like. Different indicia (e.g., company or team logos, advertisements, names, etc.) may be added to the connectors formed of separate elongated strips of material along the shoulders or collar to provide rigidly flat surfaces for effective display.

Attaching the collar and trim using a heat-transfer technique produces a smoother surface along the collar and trim for contacting a wearer's skin. For example, other traditional collars may some sort of stitching or sewing that can scratch, rub, or otherwise irritate a wearer. The collars and trim of the present invention, when attached, lie flat across wearers' skin, providing a more comfortable fit. The collars and trim also provide an enhanced visual effect by giving a place for logos, advertisements, and other indicia to be prominently displayed. For instance, a collar may include a particular team logo, city, or other indication synonymous with the wearer's team.

Assembling the front and back portions to each other may be done in various ways. Some examples of the present invention may use a heat press to meld, or infuse, the connectors to the front and back portions of the shirt. Other portions of the shirt may be sewn or stitched together. Additionally or alternatively, the connectors may be melded to the front and back portions of the shirt using a cold heat transfer or other low-temperature transfer—such as the vinyl heat transfers created by Avery Dennison®, or the like. The topmost edges (i.e., the edges covering the top of a person's shoulder) of the front and back portions may be melded using a heat-transfer technique to connectors spanning the neck of the shirt to the sleeve, as well as to the front and back portions. While the examples described herein mention a shirt's front and back portions that are separate pieces, some examples may simply use one piece that is connected along one side.

Heat-transfer techniques refer to the use of different temperatures to heat or cool connector materials and/or shirt material so that the two bond to each other. In other words, fusion of the two materials occurs as either or both of the materials are heated or cooled while placed in contact with one another. Some embodiments may also apply pressure in addition to heating or cooling to meld the connectors to the shirt material. Also, while embodiments discussed herein refer to the connectors being heated or cooled, some embodiments may alternatively apply a heat-transfer technique directly to the shirt's material instead of directly to the connectors to fuse the two together.

For the sake of clarity, it should be noted that examples described herein reference different locations or areas of a shirt as if a person were wearing the shirt. The "inside" refers to the internal surface of the shirt that would touch a wearer's skin when the shirt is on. Conversely, the "outside" refers to the surface of the shirt facing away from the wearer's body. The "back" of the shirt is the side that would typically include a shirt tag. While the "front" is the side opposite the shirt tag.

Figure 5:
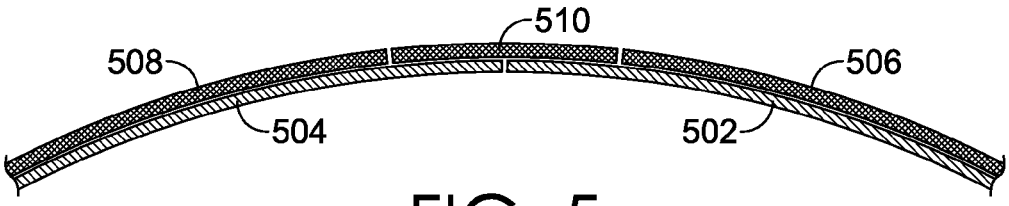
FIG. 5 illustrates different connectors attached to a shirt's fabric in accordance with one example of the present invention.

FIG. 1 illustrates a shirt 100 with shoulder and collar connectors in accordance with one example of the present invention. Shirt 100 is manufactured by combining a back portion 102 with a front portion 104 and attaching the two to various connectors using a heat-transfer technique. Back neck connector 106 is attached around the collar in the back of shirt 100, and front neck connector 108 is attached around the front of the collar. Completing the collar, right shoulder connector 110 and left shoulder connector 112 cover portions of the collar on along sides of the shirt 100, intersecting with back collar 108 and front collar 106. The four illustrated are therefore attached to shirt 100 cover the perimeter of shirt 100's collar. Also, a cross-section view showing connectors 106, 110, and 108 attached to front and back portions 102 and 104 is illustrated in FIG. 5, which is discussed below.

While shirt 100 illustrates an example of the present invention where connectors are attached to the outside of a shirt or jersey, other examples may position connectors to the inside using the heat-transfer technique. In one example, back neck connector 106, front neck connector 108, right shoulder connector 110, and left shoulder connector 112 are positioned inside shirt 100. Alternatively, only some of the connectors (e.g., back neck connector 106 and front neck connector 108) are inside shirt 100 while others (e.g., right shoulder connector 110 and left shoulder connector 112) are outside. In other words, any of the connectors may be positioned inside or outside in different examples of the present invention.

Connectors may be attached to shirt 100 using a heat-transfer technique and other traditional ways for manufacturing a shirt, such as sewing, stitching, using an adhesive, pressing, or otherwise adhering the connectors to shirt 100. To attach connectors, fabric of shirt 100 may be overlapped over an edge of the connectors. For example, back portion 102 may overlap back neck connector 106 to the inside, and front neck connector 108 may overlap front portion 104 to the outside. Alternatively, connectors may be attached such that edges of the connectors parallel edges of the shirt 100. For example, back neck connector 106 may be pressed onto shirt 100 and then trimmed to parallel the top of shirt 100's collar.

Each of the illustrated connectors (back neck connector 106, front neck connector 108, right shoulder connector 110, and left shoulder connector 112) may be made out of different materials that aid the heat-transfer process. Examples include, without limitation, silicone, TPU, vinyl, thermoplastic, elastomers, rubbers, plastics, foams, or the like. Such materials help make heat transferring possible, and using a heat transfer instead of methods for connecting shirt 100 together—e.g., solely sewing or stitching—can streamline the shirt-manufacturing process by not requiring specialized personnel and machinery to sew or stitch items together.

Although different materials of connectors 106, 108, 110, and 112 have been described, it should be understood and appreciated that other materials may alternatively be used, and that the present invention is not limited to materials described herein. For instance, examples of the present invention contemplate connectors with reflective materials or different types of taping. It should therefore be understood that the materials mentioned herein are not an exhaustive list.

Equally important to note is the fact that different examples may include additional connectors positioned at various locations as well. While FIG. 1 shows connectors around a collar and shoulder regions of a sleeveless shirt 100, some examples of the present invention may include connectors along a short or long sleeve, a seam running down the side, a bottom edge of shirt 100 (i.e., the portion meant to lie over a person's waist), or a combination thereof. Also, shirt 100 is a crew neck shirt, but present invention is not limited solely to crew neck shirts. Connectors may be attached to shirts that do not have a crew neck collar, such as a v-neck, football jersey, or the like.

Any of the connectors may be marked with an indicia 114, which may illustrate a team, logo, company, brand, advertiser, or the like. Indicia 114 may have just as easily been positioned on any of the other connectors. The connectors are ideal places for image or indicia marking because the connectors are generally rigid, flat-laying surfaces relative to the fabric of shirt 100.

Figure 2:
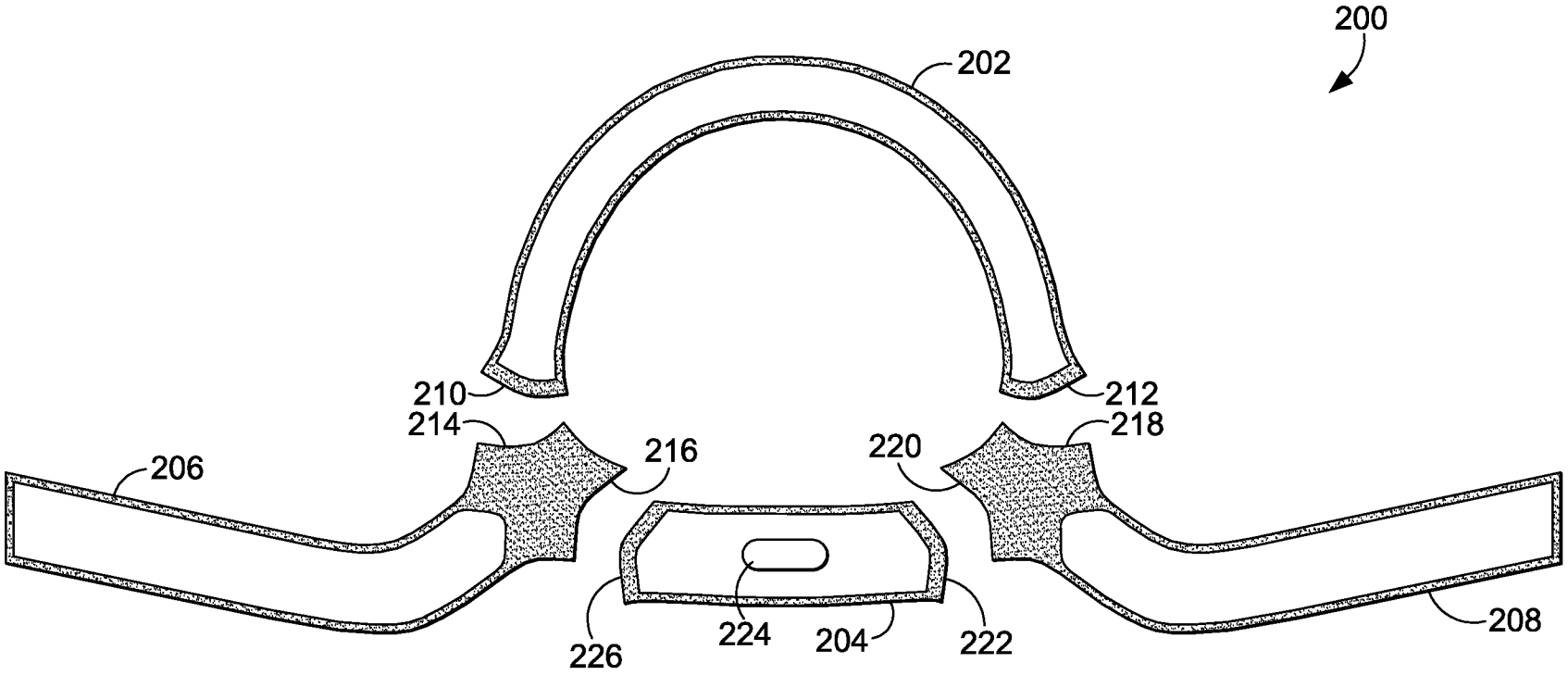
FIG. 2 illustrates an exploded view of shoulder and collar connectors in accordance with an example of the present invention.

FIG. 2 illustrates an exploded view 200 of different shoulder and collar connectors in accordance with one example of the present invention. Front connector 202 and back connector 204 intersect with left shoulder connector 206 and right shoulder connector 208 to create a continuous collar. Front connector 202 includes two protruding, arcuately convex ends 210 and 212 that intersect with arcuately concave ends 214 and 218 on left shoulder connector 206 and right shoulder connector 208, respectively. Similarly, back connector 204 also includes two protruding, arcuately convex ends 222 and 226 that are received by arcuately concave ends 220 and 216 of right shoulder connector 208 and left shoulder connector 206, respectively. The four connectors, when intersecting, create a continuous collar around a shirt, as well as provide places (left shoulder connector 206 and right shoulder connector 208) for the shirt's component portions to be connected without seams. Back connector 204 is also marked with indicia 224, which may illustrate virtually anything, such as advertisements, brands, logos, companies, teams, or the like.

While ends of connectors are illustrated as arcuately convex and concave ends, other ends may alternatively or additionally used. The ends may be straight, angled, interlocked, interleaved (e.g., dovetail, tongue-and-groove, or the like), or otherwise connected to create the continuous collar. Many different types of interlocking connective protrusions and receptacles may be used, too many in fact to discuss herein at length. Other examples may not have ends actually intersect or touch one another, instead leaving gaps between different connectors. It should therefore be understood and appreciated that different examples will position the connectors in different orientations using various ends, while other examples may connectors that do not touch or intersect with each other.

Figure 3:
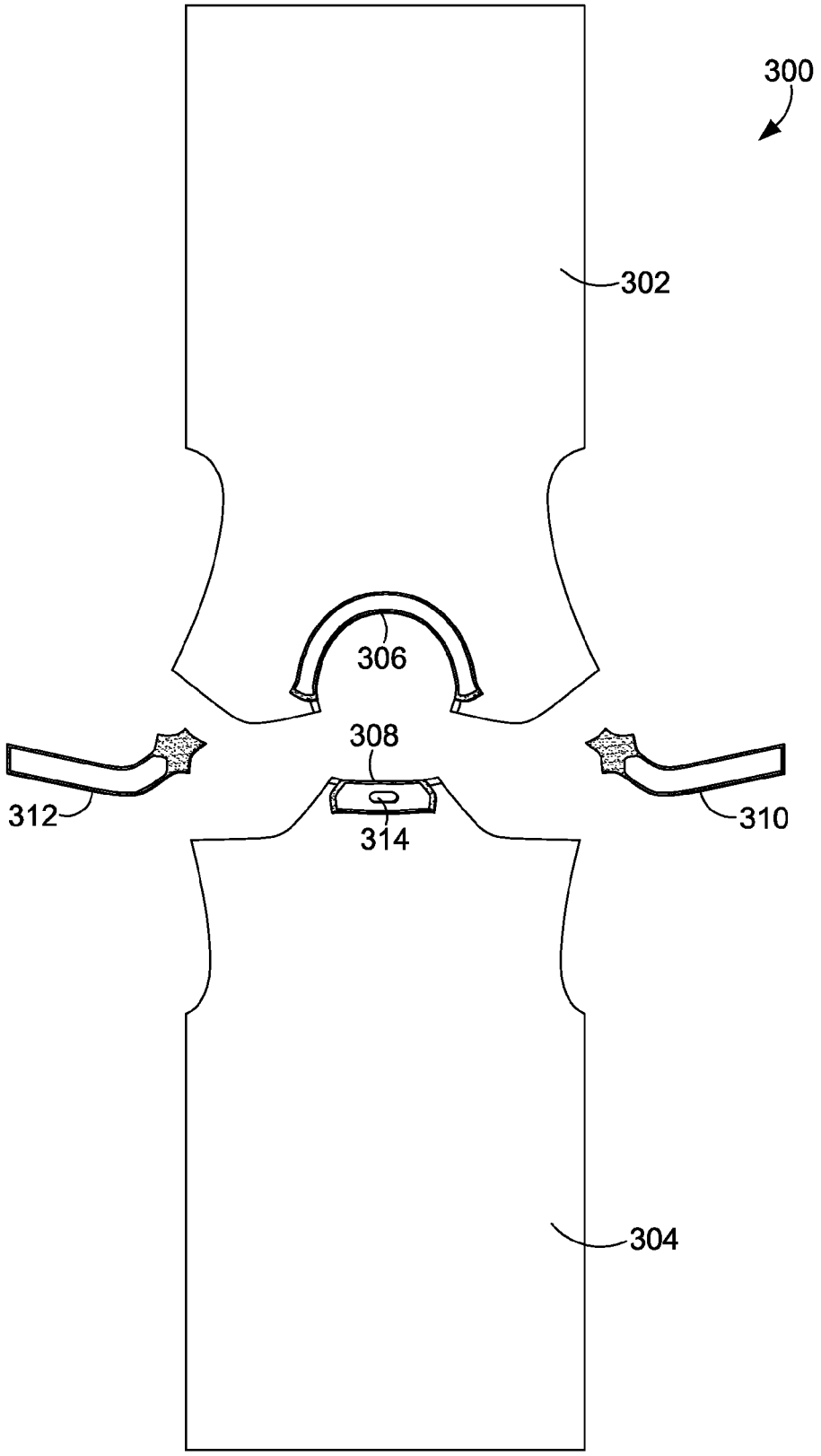
FIG. 3 illustrates an exploded view of two portions of a shirt and connectors spanning the collar and shoulders of the portions in accordance with an example of the present invention.

FIG. 3 illustrates an exploded view 300 of two portions of a shirt and connectors spanning the collar and shoulders of the portions in accordance with one example of the present invention. Front portion 302 and back portion 304 are connected to each other along edges running from collar to shoulder. Front neck connector 306 and back neck connector 308 create a continuous collar by fitting within various ends of right shoulder connector 310 and left shoulder connector 312. Additionally, indicia 314 is prominently displayed on back connector 308 and can potentially an advertisement, logo, brand, team, or other illustration for creating brand-recognition purposes. Examples where the connectors are positioned inside the shirt may also include indicia 314 to create brand-recognition with the wearer of the shirt.

Figure 4:
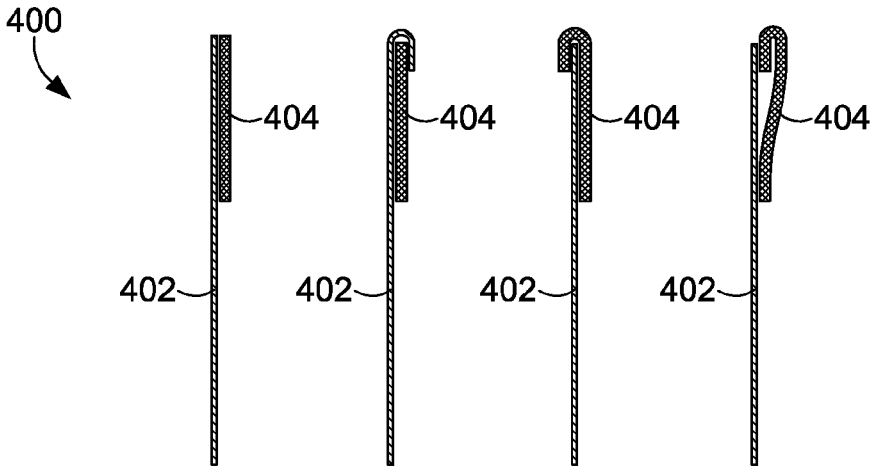
FIG. 4 illustrates four different examples of a connectors aligning with edges of a shirt in accordance with an example of the present invention.

FIG. 4 illustrates four different examples of connectors aligning with edges of a shirt in accordance with the present invention. The top portions of the four examples depicted in view 400 represent the upper edges of a shirt collar and the corresponding connectors attached thereto. Fabric 402 of the shirt may end in parallel with connector 404, as shown in the left example. Fabric 402 may alternatively overlap connector 404, or vice versa, as shown by the two innermost examples. Yet still, as shown in the right example, connector 404 may be curled over the top edge, with the curl abutting against fabric 402. Connector 404 may be attached to fabric 402 in any of the illustrated ways, or a combination thereof.

FIG. 5 illustrates a view 500 of different connectors attached to a shirt's fabric in accordance with one example of the present invention. Fabric portions 502 and 504 represent the front and back portions of a shirt, respectively. As shown, the two come together at a seam. Attached to the shirt's fabric are front neck connector 506, shoulder connector 510 (either left or right), and back neck connector 508. By affixing the fabric of front portion 502 and back portion 504 directly to shoulder connector 510 using a heat-transfer technique, no stitching and resultant seam is created along the shirt's shoulder. As a result, potentially irritating seams created by sewing or stitching are eliminated.

Figure 6:
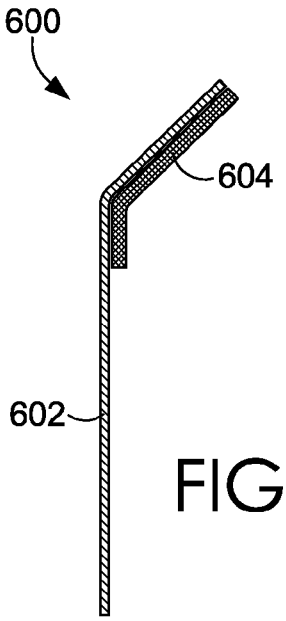
FIG. 6 illustrates a connector attached to fabric of a shirt in accordance with one example of the present invention.

FIG. 6 illustrates a view 600 of a connector attached to fabric of a shirt in accordance with one example of the present invention. Fabric 602 of the shirt is attached with connector 604 such that connector 604 only traverses a small portion of fabric 602 around the perimeter of the collar. Connector 604 may be fashioned to bend at a point corresponding to the bottom groove in a person's neck. In this example, the end of connector 604 does not rest directly in the person's neck groove, something that could potentially be irritating over the course of a highly active athletic game. Instead, the smaller portion of connector 604—the portion after the bend at the bottom—rests against the person's neck and supports the top portion of connector 604. More surface area of connector 604 resting against the person's upper chest alleviates potential irritation of connector 604, which may be heavier than fabric 602.

Figure 7:
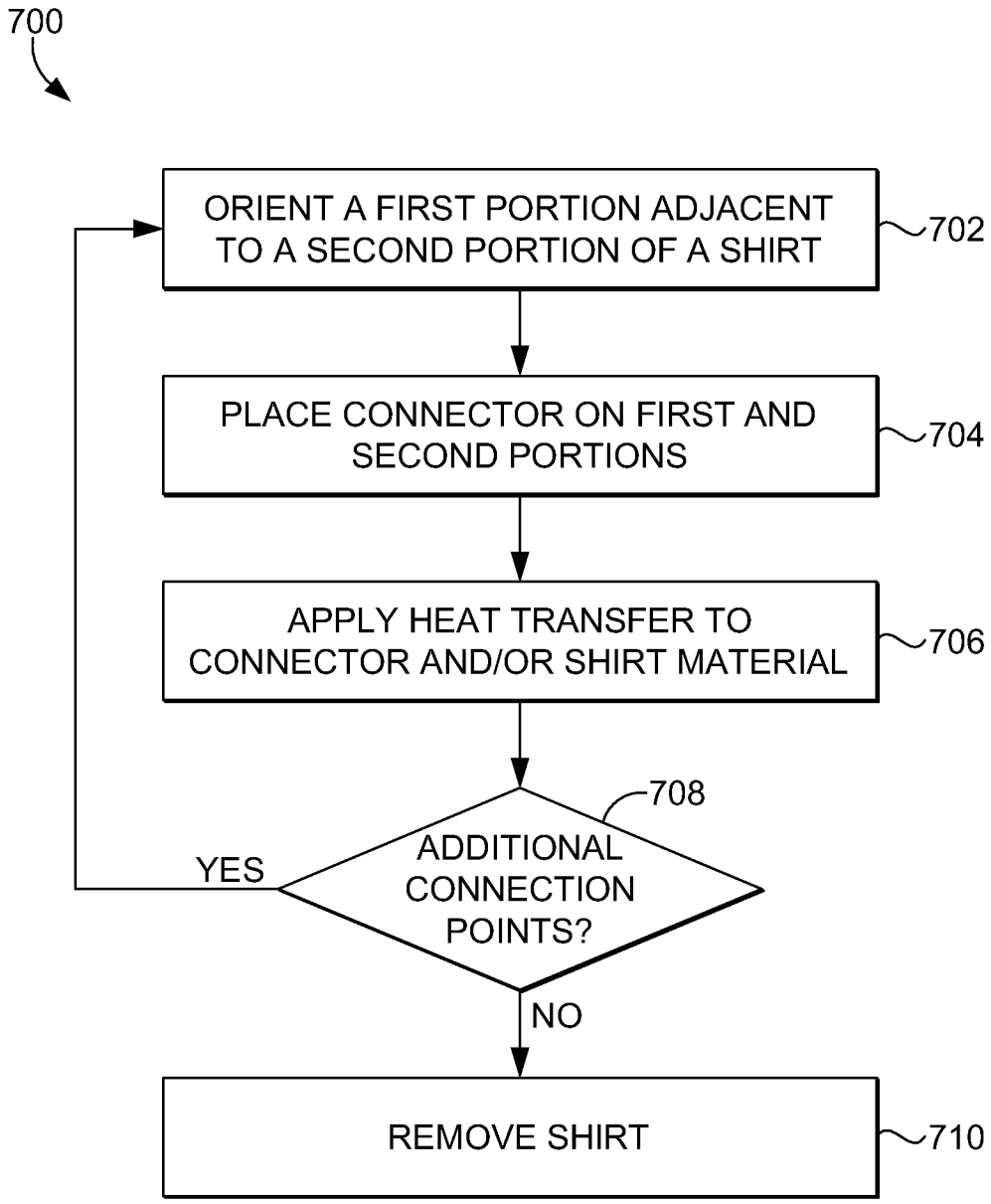
FIG. 7 illustrates a flow chart detailing a work flow for adding connectors around a shirt collar and/or shoulder seams in accordance with one example of the present invention.

FIG. 7 illustrates a flow chart detailing a work flow 700 for adding connectors around a shirt collar and/or shoulder seams in accordance with one example of the present invention. The connectors are added using a heat-transfer technique instead of or in addition to stitching or sewing. Steps of work flow 700 may be carried out mechanically in an assembly-line type manner, while other steps may be performed manually; however, not all steps are required in every embodiment of the present invention. Some embodiments may include additional or different steps.

As shown at 702, a first portion of a shirt is oriented adjacent to a second portion. For example, the shoulder edge of a front portion of a shirt may be lined up with the shoulder edge of a back portion, either by a human or by a mechanized device. A connector is placed either atop or below the first and second portions of the shirt where the two meet, as shown at 704. A heat-transfer is performed to meld the connector to the shirt, as shown at 706. As previously mentioned, the heat-transfer may apply heat, cold, pressure, or a combination thereof to ensure fusion of the connector with the first and second portions of the shirt. Decision box 708 indicates that connectors may need to be melded to the shirt at different connection points (e.g., the opposite shoulder, along side portions, etc.), and if so, steps 702-706 are repeated for each connection point. If no more connection points are needed, the shirt is removed from or passed along to other production areas, as shown at 710.

The present invention has been described in relation to particular embodiments, which are intended in all respects to illustrate rather than restrict. Alternative embodiments will become apparent to those skilled in the art that do not depart from its scope. Many alternative embodiments exist, but are not included because of the nature of this invention.

Although the subject matter has been described in language specific to structural features and methodological acts, it is to be understood that the subject matter defined in the appended claims is not necessarily limited to the specific features or acts described above. Instead, the specific features and acts described above are disclosed as example forms of implementing the claims.

The invention claimed is:

1. A shirt, comprising:

a front portion and a back portion; and at least four connectors separate from the front portion and the back portion formed of separate elongated strips of material, the at least four connectors comprising:

(1) a front collar connector melded to the front portion;

(2) a back collar connector melded to the back portion;

(3) a left shoulder connector, wherein the front portion and the back portion are affixed to the left shoulder connector to create a left shoulder seam; and (4) a right shoulder connector, wherein the front portion and the back portion are affixed to the right shoulder connector to create a right shoulder seam, and further wherein the front collar connector, the back collar connector, the right shoulder connector, and the left shoulder connector intersect with each other to form a continuous collar for the shirt surrounding the entire neck of a wearer when the shirt is worn.

2. The shirt of claim 1, further comprising an indicia on at least one of the left shoulder connector, the right shoulder connector, the front collar connector, or the back collar connector.

3. The shirt of claim 1, wherein at least one of the left shoulder connector, the right shoulder connector, the front collar connector, or the back collar connector include silicone.

4. The shirt of claim 1, wherein at least one of the left shoulder connector, the right shoulder connector, the front collar connector, and the back collar connector include thermoplastics polyurethane (TPU).

5. The shirt of claim 1, wherein the front portion forms a crew neck or a v-neck.

6. The shirt of claim 1, wherein at least one of the left shoulder connector, the right shoulder connector, the front collar connector, or the back collar connector is attached underneath the front and the back portions.

7. The shirt of claim 1, wherein at least one of the left shoulder connector, the right shoulder connector, the front collar connector, or the back collar connector is attached on top of the front and the back portions.

8. The shirt of claim 1, wherein the front collar connector comprises an arcuate front collar with two arcuately convex ends that are received by arcuately concave ends on the left shoulder connector and the right shoulder connector.

9. The shirt of claim 1, wherein the front collar connector comprises an arcuate front collar with two arcuately concave ends that are received by arcuately convex ends on the left shoulder connector and the right shoulder connector.

10. The shirt of claim 1, further comprising a left longitudinal connector and a right longitudinal connector connecting the front portion to the back portion, wherein the left and right longitudinal connectors each connect the front and the back portions from an armpit area to a bottom of the shirt.

11. A shirt, comprising:

a front portion;

a back portion; and four connectors separate from the front portion and the back portion formed of separate elongated strips of material and attached to the front and back portions in a manner that creates a continuous collar surrounding the entire neck of a wearer when the shirt is worn, the four connectors comprising:

(1) a front collar connector with first arcuately convex ends and melded to the front portion, (2) a back collar connector with second arcuately convex ends and melded to the back portion, (3) a left shoulder connector and a right shoulder connector melded to both the front and back portions, each of the left and right shoulder connectors including arcuately concave ends that receive one of the first arcuately convex ends of the front collar connector and one of the second arcuately convex ends of the back collar connector.

12. The shirt of claim 11, wherein each of the four connectors include silicone or thermoplastics polyurethane (TPU).

13. The shirt of claim 11, wherein at least one of the four connectors is attached to the inside of the front and back portions.

14. The shirt of claim 11, wherein at least one of the four connectors is attached to the outside of the front and back portions.

15. The shirt of claim 11, further comprising an indicia on at least one of the four connectors.

16. A continuous collar attached to an outside portion of a shirt, the collar comprising at least four connectors formed of separate elongated strips of material, the at least four connectors comprising:

a front collar connector with two ends;

a back collar connector with two other ends; and a left shoulder connector and a right shoulder connector melded to both a front portion and a back portion of the shirt, the left and right shoulder connectors each intersecting with an end of the front collar connector atop the front portion of the shirt and intersecting with an end of the back collar connector atop the back portion of the shirt, wherein the front collar connector, the back collar connector, and the left and right shoulder connectors are melded to the front portion and the back portion of the shirt using a heat-transfer technique to form the collar for the shirt, wherein the collar is adapted to surround the entire neck of the wearer when the shirt is worn.

17. The continuous collar of claim 16, wherein edges of the front collar connector and the back collar connector align with top edges of the front portion and the back portion of the shirt.

18. The continuous collar of claim 16, wherein edges of the front collar connector the back collar connector overlap top edges of the front portion and the back portion of the shirt.

19. The continuous collar of claim 16, wherein the back collar connector is marked with an indicia of a logo.

* * * * *